US012605804B2

(12) United States Patent
van der Meer et al.

(10) Patent No.: US 12,605,804 B2
(45) Date of Patent: Apr. 21, 2026

(54) ABRASIVE ARTICLE

(71) Applicant: 3M INNOVATIVE PROPERTIES COMPANY, St. Paul, MN (US)

(72) Inventors: Marijke van der Meer, Welliehausen (DE); Jean-Luc Rifaut, Brussels (BE)

(73) Assignee: 3M Innovative Properties Company, St. Paul, MN (US)

( * ) Notice: Subject to any disclaimer, the term of this patent is extended or adjusted under 35 U.S.C. 154(b) by 584 days.

(21) Appl. No.: 17/270,983

(22) PCT Filed: Aug. 23, 2019

(86) PCT No.: PCT/IB2019/057116
§ 371 (c)(1),
(2) Date: Feb. 24, 2021

(87) PCT Pub. No.: WO2020/049395
PCT Pub. Date: Mar. 12, 2020

(65) Prior Publication Data

US 2021/0323122 A1 Oct. 21, 2021

(30) Foreign Application Priority Data

Sep. 3, 2018 (EP) ..... 18192273

(51) Int. Cl.
*B24D 3/34* (2006.01)
*B24D 7/06* (2006.01)

(52) U.S. Cl.
CPC ..... *B24D 3/34* (2013.01); *B24D 7/063* (2013.01); *B24D 2203/00* (2013.01); *B24D 2205/00* (2013.01)

(58) Field of Classification Search
CPC ..... B24D 3/34; B24D 3/346; B24D 2203/00; B24D 2205/00; B24D 11/00; B24D 3/00; B24B 37/24–26; B24B 37/12–16
See application file for complete search history.

(56) References Cited

U.S. PATENT DOCUMENTS 5,736,427 A 4/1998 Henderson
6,019,666 A * 2/2000 Roberts ..... B24D 7/066 451/36

(Continued)

FOREIGN PATENT DOCUMENTS

DE 4424203 1/1996
DE 4424203 A1 * 1/1996 ..... B24B 9/14

(Continued)

OTHER PUBLICATIONS

Machine Translation of KR 20150001394—"394 Translation" (Year: 2015).*

(Continued)

*Primary Examiner* — Monica S Carter
*Assistant Examiner* — Jonathan R Zaworski
(74) *Attorney, Agent, or Firm* — Melissa E. Buss

(57) ABSTRACT

The invention relates to an abrasive article 1 for abrading at least one workpiece, the abrasive article with: a carrier body 2, at least one abrasive layer 3 with a main surface and a predefined thickness, the at least one abrasive layer being arranged on the carrier body, at least two visual indicators 6 with a cross-section in the main surface of the abrasive layer, wherein the size, shape and/or location of the cross-section of the visual indicators in the main surface of the abrasive layer depends on the thickness of the abrasive layer at more than one location of the visual indicators.

10 Claims, 5 Drawing Sheets

(56) References Cited

U.S. PATENT DOCUMENTS

Figure 1:
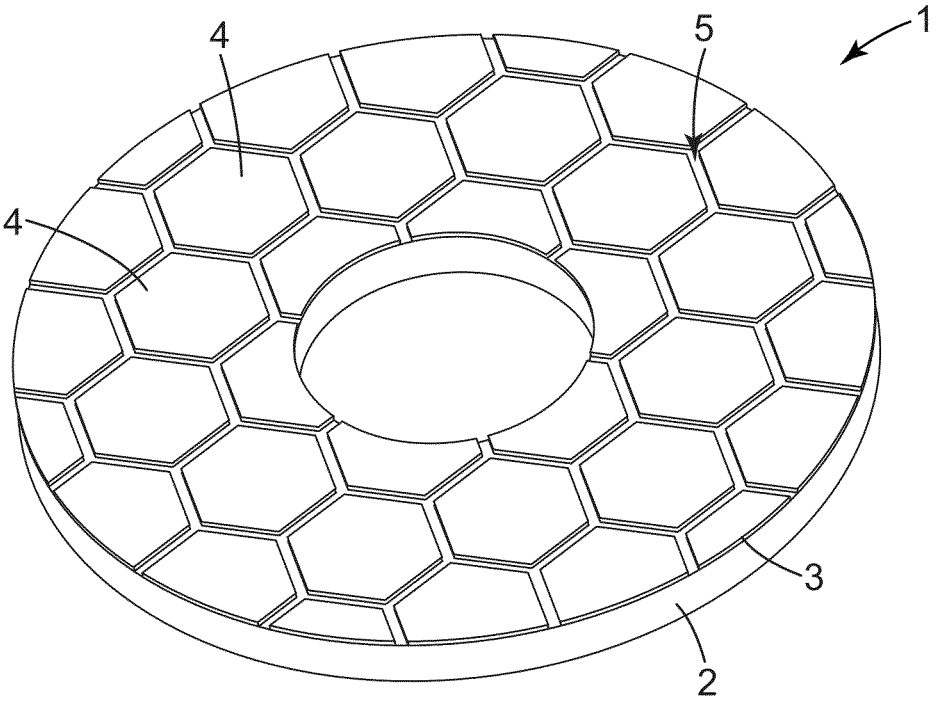

| | | | | | |
|---|---|---|---|---|---|
| 6,090,475 | A * | 7/2000 | Robinson | ..... | B24D 11/00 451/6 |
| 6,106,661 | A * | 8/2000 | Raeder | ..... | B24B 37/26 451/259 |
| 6,250,295 | B1 * | 6/2001 | Chanton | ..... | B28D 1/121 125/20 |
| 2002/0182986 | A1 * | 12/2002 | Tung | ..... | B24B 37/20 451/56 |

FOREIGN PATENT DOCUMENTS

| | | | | | |
|---|---|---|---|---|---|
| EP | 1201386 | | 5/2002 | | |
| KR | 20150001394 U | * | 4/2015 | ..... | B24B 37/26 |
| WO | WO2003/008151 | | 1/2003 | | |

OTHER PUBLICATIONS

International Search report for PCT International Application No. PCT/IB2019/057116 mailed on Nov. 7, 2019, 4 pages.
1507 Extended EP Search Report for EP18192273.3, Apr. 17, 2019, 3 pages.

* cited by examiner

ABRASIVE ARTICLE

CROSS REFERENCE TO RELATED APPLICATIONS

This application is a national stage filing under 35 U.S.C. 371 of PCT/IB2019/057116, filed Aug. 23, 2019, which claims the benefit of European Application No. 18192273.3, filed Sep. 3, 2018, the disclosures of which are incorporated by reference in their entireties herein.

The invention relates to an abrasive article for grinding at least one workpiece, the abrasive article comprising a carrier body and at least one abrasive layer. The invention also relates to an abrasive layer for an abrasive article. Finally, the invention relates to a kit of parts with a pair of abrasive articles.

Abrasive articles comprising an abrasive layer are used to grind, abrade, finish and/or polish a wide variety of materials, commonly referred to as workpiece, in a wide variety of applications. These applications range from for example high surface finish level, high level of parallelism of metal to finish camrod. In the context of this patent application abrading or grinding is used for any kind of removal of material of a workpiece. Abrasive process or grinding process is used to describe any kind of removing process of material of a workpiece.

In order to be able to run a highly effective, high quality abrasive or grinding process, the main surface of an abrasive layer of an abrasive article should in general be perfectly plane and parallel to the final surface of the workpiece to be grinded.

Double disk grinding, for example is an area of abrasive processes where these requirements are especially important because double disk grinding is a very complex process. Double disk grinding is a process, where several workpieces are hold by carriers that are rotating between an inner and an outer ring while two parallel also rotating grinding wheels are arranged on top and below the workpieces. Through this process material is removed from the workpieces parallel from both sides. Due to diverse materials and size of workpieces connected with varying grinding wheel and carrier layouts as well as processing parameters, here especially the rotational speed of grinding wheels and carriers, the grinding wheels can develop different geometry deviations. They may for example develop concave or convex patterns across the diameter of the grinding wheel. These circumstances may influence the quality of the produced part.

Currently, the geometry and the wear of abrasive articles is controlled by regularly measuring the shape of the abrasive articles, e.g. wheels, and where appropriate the size of the gap between two wheels and document these values. By regularly comparing the documented values it is possible to define the direction of wear. These measurements may be very time consuming. During the process of measurement, no grinding is possible.

Another challenge in the area of abrasive articles, is to exactly define the thickness of the abrasive layer. This might for example be important in order to decide when the abrasive article needs to be replaced. The definition of the correct replacement time is crucial for the quality of the abrasive process as well, since it should be avoided that the abrasive article is used until the abrasive layer is completely worn off. Especially for large abrasive articles, like grinding wheels for double disk grinding, which are fairly expensive and that are usually not hold on stock, it is important to predict as exactly as possible the time, when the abrasive layer is worn off, to be able to order new abrasive articles in due time.

It is known, to use dummy layers underneath the abrasive layer, which comprise no or different abrasive particles. They may either extend underneath the entire abrasive layer. In such a case, they appear, when the abrasive layer is worn off and avoid a direct contact of the workpiece with the carrier body of the abrasive article. The dummy layers may also be arranged punctually underneath the abrasive layer. In such a case they indicate a near end of the abrasive layer and therewith of the tool life. When they appear, the user knows that the end of the life time of the abrasive article is close. These dummy layers may help to prevent quality issues that may occur when the workpiece gets in direct contact with the carrier of the abrasive layer. Dummy layers as described above do not help to detect shape deviations or identify actual layer heights or thicknesses during the entire life time of an abrasive article.

Other wear indicators are known as well. DE 4 424 203 A1 discloses for example an abrasive article with a wear indicator in the form of a rod or ring with a triangular cross-section.

EP 1 201 386 A2 discloses a cutting member for a masonry cutting tool, comprising a cutting edge which wears in use. At least one lateral side of the cutting member is provided with indicator means formed therein to provide an indication of lateral wear of the cutting member.

In view of the above there is still a need for an abrasive article that overcomes the above-mentioned challenges. Especially there is a need for an abrasive article with more efficient means for identifying the thickness of an abrasive layer at a certain location at any time during the life time of the abrasive article. There is also the need for an abrasive layer for an abrasive article with more efficient means for identifying the thickness of the abrasive layer. And there is finally a need for a kit of parts with at least one abrasive article as mentioned above.

The present invention provides an abrasive article for abrading at least one workpiece, the abrasive article comprising:

- a carrier body,
- at least one abrasive layer with a main surface and a predefined thickness, the at least one abrasive layer being arranged on the carrier body,
- at least two visual indicators with a cross-section in the main surface of the abrasive layer, wherein the size, shape and/or location of the cross-section of the visual indicator in the main surface of the abrasive layer depends on the thickness of the abrasive layer at the location of the visual indicator.

Abrasive articles with a carrier body and an abrasive layer are well known. As already pointed out above, they are used to abrade, grind, finish and/or polish a wide variety of materials, commonly referred to as workpiece, in a wide variety of applications.

Carrier bodies of abrasive articles are usually made out of metal, polymers e.g. polyamide, phenolic based compound filled with metal particles, or ceramics. Carrier body can also be a sintered body e.g. made of glass frit and filling materials e.g. Silicon Carbide and or Aluminum Oxide. In most of the cases they are shaped such that they may be used on machines comprising a rotary drive. Therefore, common shapes of carrier bodies of abrasive articles are disks or cylindrically shaped carrier bodies.

Abrasive articles further provide at least one abrasive layer that is arranged on a surface of the carrier body. The abrasive layer is the layer of the abrasive article that is used for abrading or grinding the workpiece. If the carrier body is a disk, they may be arranged on at least one of the two parallel surfaces of the carrier body. When the carrier body is cylindrically shaped, the abrasive layer may also be arranged on the circumferential surface of the carrier body. Any other known shapes of abrasive articles are possible as well.

The abrasive layer according to the invention may comprise any kind of known materials usually used for abrasive layers. They may provide abrasive particles and a permanent binder. The permanent binder may be organic or inorganic. Examples of organic binders include for example phenolic resins, urea-formaldehyde resins, polyurethane, polyimide, polyamide-imide and epoxy resins. Examples of inorganic binders include metals (such as nickel, iron, bronze, copper cobalt, silver), and metal oxides. Metal oxides are usually classified as either a glass (vitrified), ceramic (crystalline), or glass-ceramic. Specific examples of the permanent binder include glass powder and colloidal metal oxides, for example, silica. The abrasive particles suitable for this invention may be any kind of known abrasive particles, such as for example superabrasives, like diamonds and cubic boron nitride (CBN) or the like, as well as other abrasives, like corundum ($Al_2O_3$), silicon carbide (SiC), boron carbide ($B_4C$). Finally, the abrasive layer may optionally comprise any kind of additives, such as fillers (including grinding aids), fibers, antistatic agents, lubricants, wetting agents, surfactants, pigments, dyes, coupling agents, plasticizers, and suspending agents. The amounts of these materials can be selected to provide the properties desired.

The abrasive layer according to the invention further comprises a main surface, which is the surface of the abrasive layer, which is used to grind a workpiece and which usually faces away from the carrier body. This main surface is usually plane, in order to be able to create plane surfaces on the workpiece as well. The abrasive layer usually wears off when the abrasive article is used. Then, the thickness of the abrasive layer decreases and the main surface shifts towards the carrier body of the abrasive article. If the abrasive article is a disk, the main surface may extend in a radial direction. If the abrasive article has a cylindrical shape, and the abrasive layer may be arranged on the circumferential surface, the main surface of the abrasive layer may also extend on the circumferential surface of the abrasive article and provide a concentric shape.

The abrasive layer according to the invention also comprises a predefined thickness. The thickness of an abrasive layer according to the invention is the extension of the abrasive layer in the direction of the wear. Usually the thickness of an abrasive layer is constant over the entire extension of the abrasive layer. It is—in rare cases—also possible that the thickness of the abrasive layer varies over its extension. As already described above, the thickness decreases over the life time of an abrasive article due to a wear or wear off process of the abrasive layer.

The abrasive layer may be fixed to the carrier body through suitable fixing system means such as for example adhesives. One example of a suitable adhesive is the 3M™ Scotch-Weld® 9323 B/A (commercially available from 3M Cooperation, St. Paul, MN, USA). Other options to fix the abrasive layer to the carrier body are pressing (e.g. for a resin bonded abrasive layer), brazing or clamping. It is also possible that the carrier body and the abrasive layer may be sintered together in one process step.

As already mentioned above, the abrasive layer wears off during the use of the abrasive article. During this process the thickness of the abrasive layer gets continuously reduced. The reduction of the thickness may be the same over the entire extension of the abrasive layer. In other words, at each locations of the abrasive layer it wears off with the same rate. It is also possible that the reduction of the thickness of the abrasive layer is not the same over its extension. In the latter case, it is possible that the main surface of the abrasive layer derivates after some time of using the tool from a plane shape or from a for example concentric shape.

In order to be able to easily detect this derivation from the plane shape or from the concentric shape of the main surface of the abrasive layer and also in order to be able to easily define the thickness of the abrasive layer, the invention proposes at least two visual indicators with a cross-section in the main surface of the abrasive layer, wherein the size, shape and/or location of the cross-section of the visual indicator in the main surface depends on the thickness of the abrasive layer at more than one location of the visual indicator. The visual indicator may be any kind of indicator or mark in the abrasive layer that can visually be detected. It may extend through the majority of the thickness of the abrasive layer from its main surface towards the surface that is opposite of the main surface and that is directed towards the carrier body of the abrasive article. The visual indicator has a shape with a varying cross-section in a plane that extends parallel to the main surface. If more and more material of the abrasive layer is worn off during the use of the abrasive article, the visible shape or size of the visual indicator on the main surface of the abrasive layer changes. The shape of the visual indicator may stay the same and its size changes. But it is also possible, that the shape changes. And it is also possible that the position of the visible indicator on the main surface changes while material of the abrasive layer is worn off.

With such a configuration an abrasive article may be provided, where the size, shape or location of a cross-section of the at least two visual indicators in the main surface correspond to a certain thickness of the abrasive layer at more than one location of the visual indicator. It is therefore possible, by looking at the visual indicator and identifying its size, shape and/or location to define the thickness of the abrasive layer at a location. This information may be important for different purposes, one being the decision if the main surface needs to be revised so that it has the same thickness over its entire extension and is plane or concentric again, and another being the decision if the whole abrasive article needs to be replaced, because the abrasive layer is worn off. An additional advantage of the invention might be that customers using the abrasive article according to the invention gets the information that machining parameters might need to be adapted to generate a more homogeneous wear behavior on the entire abrasive article surface.

Providing at least two visual indicators enables to compare the visual indicators with each other and to compare thicknesses at different locations with each other. At every location where a visual indicator is arranged the information about the thickness of the abrasive layer is provided. It is also possible, that the at least two visual indicators are equally shaped, or equally sized. The visual indicators may also all be positioned at the same height within the abrasive layer. Such a configuration allows to compare all the cross-sections of the visual indicators at the main surface of the abrasive article. If the visual indicators are all equally shaped and/or all provide the same size, and if they are all positioned in the same height within the abrasive layer, a comparison of the cross-section in the main surface of the visual indicators provides very quickly the information if the thickness of the abrasive layer is the same over the entire extension of the abrasive article. This is the case, when the cross-sections of the visual indicators in the main surface all have the same size or shape. If the size or shape of the cross-sections of the at least two visual indicators differ from one another, the thickness of the abrasive layer may vary across its extension and a rework of the main surface may be necessary.

According to one embodiment of the invention, the visual indicators comprise a predefined shape with a cross-section that is visible on the main surface of the abrasive layer. The cross-section of the visual indicator may comprise any kind of predefined shape on the main surface, such as for example a round, square, oval, or random shape. The shape may either stay the same on the main surface over the use of the abrasive article and only the size of the visual indicator may change with decreasing thickness of the abrasive layer. It is also possible, that the shape of the visual indicator on the main surface of the abrasive layer changes with decreasing thickness. Another possibility is that the location of the visual indicator changes with decreasing thickness.

According to another embodiment of the invention the visual indicator is visible through the whole life time of the abrasive article. With such an embodiment it is possible to identify the thickness of the abrasive layer at any time through the life time of the abrasive article. It is of course also possible, that the visual indicator is only visible after the thickness of the abrasive layer has already been reduced. It is also possible, that the visual indicator is not visible at the end of the life time of the abrasive article. In these embodiments, the visual indicator would only extend from a location spaced apart from the main surface of the abrasive layer to a location spaced apart from the surface of the abrasive layer that is opposite of the main surface. Another possibility is that the visual indicator is only visible during certain thickness ranges of the abrasive layer.

It is also possible that the visual indicator comprises a cross-section in a plane parallel to the main surface of the abrasive layer that varies through the thickness of the abrasive layer. Again, the changing cross-section can be used to correlate it to the thickness of the abrasive layer. The changing cross-section then carries information about the thickness of the abrasive layer at the location of the visual indicator which can be used in the above described manner.

The abrasive article may further comprise more than two visual indicators. Having more than two visual indicators allows to provide information about the thickness of the abrasive layer at more than two locations which allows a more accurate assessment of the status of the main surface.

The visual indicators may be arranged in a pattern in the abrasive layer. When the abrasive article is for example a disk, it is possible to position the visual indicators at an outer ring that is positioned closer to the outer rim of the disk shaped abrasive article. It is also possible to position the visual indicators at an inner ring that is positioned closer to the middle of the disk shaped abrasive article. With such a configuration the wear of the abrasive article at an outer area of the disk can be compared with the wear off closer to the middle of the disk. Any other arrangement of the visual indicators on abrasive article is possible as well, such as random arrangement of the at least two visual indicators. The at least two visual indicators may also be arranged at different defined angles relative to each other, for example every 30°, 60°, 90° etc., or any other suitable sequence of angles. The at least two visual indicators may also be arranged in one line; in only one circle or in more than two circles with a specific distance along the radius; within each corner of a square, of a pentagon, or any other suitable polygon.

The at least two visual indicators may be conically shaped. A conic shape is a simple shape that is easy to visually detect. In addition, it is relatively easy to manufacture an abrasive layer with conically shaped visual indicators. The changing cross-section of the conic shape over its height provides the needed correlation between size of the visual indicator and height respective thickness of the abrasive layer.

The at least two visual indicators may also provide any other three-dimensional shape that provides changing cross-sections over its height. They may for example be designed as a continuous indicator or marking. One example of a continuous indicator is a visual indicator in a helical shape that is built by a narrow ramp which is brought into a circular shape. It may also be designed as a ramp that is not brought into a circular shape. In both embodiments you see at the beginning of the wear no visual indicator, after a short while you see a small section of the ramp, either in a circle or as a straight ramp and at the end you see a complete circle/ring or line. It is also possible to arrange the visual indicators the other way around, that you see at the beginning the entire circle/ring or line and at the end nothing.

The at least two visual indicators may also be designed as a discrete indicator or marking, where the indicator comprises several discrete elements that appear or disappear in a defined order and that build together one visual indicator. The discrete elements of the discrete indicator may be arranged in different heights within the abrasive layer of the abrasive article in order to appear or disappear. One example of such a discrete visual indicator is a clock like system, with 12 or any other number of discrete elements or markers that are arranged in a circle and that appear or disappear one after the other during the use of the abrasive tool while the thickness of the abrasive layer is reduced.

The abrasive layer may be continuous, or it may be discontinuous. A continuous layer has one main surface. If the abrasive layer is discontinuous, it may have a main surface as well, but the main surface may be interrupted for example by small channels or other equivalent interruptions.

A discontinuous abrasive layer may comprise several segments or pellets. The segments or pellets may be equally shaped and/or equally spaced apart from each one another. They may for example provide a triangular shape, a four-sided shape, hexagonal shape, heptagonal shape and so on. They may also be differently shaped. The segments or pellets may all have the same thickness. And they may be arranged such that they build with their surfaces the main surface of the abrasive layer.

It is possible that at least two segments or pellets comprises a visual indicator according to the invention. It is also possible that more than one segments, or pellets comprises a visual indicator. The segments or pellets with the visual indicator may be arranged in a pattern on the carrier body of the abrasive article.

The at least two visual indicators according to the invention may comprise a colour that is different from the colour of the abrasive layer. filling the gap with a different material, such as for example a colored organic or inorganic material, e.g. resin. A different colour in the main surface of the abrasive layer that is something that is easy to visually detect. It therefore allows for a quick inspection process. The necessary information about the thickness of the abrasive layer can very quickly be achieved by looking onto the main surface of the abrasive article and inspecting and comparing visual indicators on the main surface. The different colour of the visual indicator may for example be achieved by building a gap in the abrasive layer and afterwards filling the gap with a coloured material or with a different material than the abrasive layer. It is possible that the visual indicators comprise the same wear properties as the rest of the abrasive layer. It is also possible that the visual indicators comprise different wear properties as the rest of the abrasive layer.

It is for example possible that the visual indicator comprises a different material or a different material composition as the abrasive layer. One possibility would for example be, that the visual indicator only comprises the permanent binder without any abrasive particles. If the same permanent binder is used as for the rest of the abrasive layer, the production process may be simpler compared to using a different permanent binder. It is of course also possible that the same material or material composition as for the abrasive layer is used. It is also possible to have at least two visual indicators that are not filled with anything, where the above-mentioned gap is not filled and only comprises air.

The abrasive article according to the invention may be any kind of known abrasive article, such as for example a grinding tool, e.g. a grinding wheel such as a fine grinding wheel or a face grinding wheel, or a dressing ring.

The invention also relates to an abrasive layer with a main surface and a predefined thickness, as well as at least one visual indicator with a cross-section in the main surface of the abrasive layer, wherein the size, shape and/or location of the cross-section of the visual indicator in the main surface of the abrasive layer depends on the thickness of the abrasive layer at the location of the visual indicator for an abrasive article as described above.

The invention also relates to a pair of abrasive articles for use in a double disk grinding process, wherein at least one of the abrasive articles is an abrasive article according to any of the above described embodiments, preferably both abrasive articles are abrasive articles according to any of the above described embodiments.

Figure 2A:
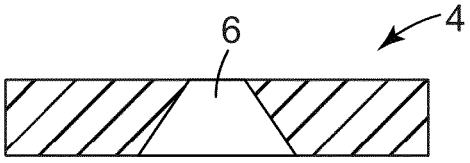
Figure 2B:
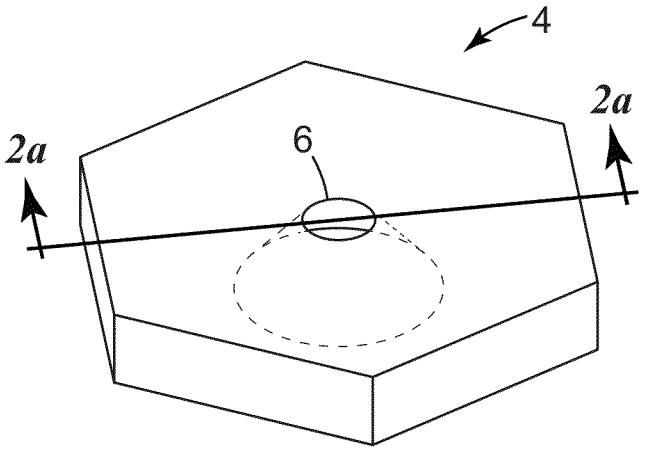

The invention will now be described in more detail with reference to the following Figures exemplifying particular embodiments of the invention:

FIG. 1 three-dimensional view of a grinding wheel with a carrier body and an abrasive layer;

FIG. 2*a* cross-sectional view of a segment of an abrasive layer of an abrasive article with one embodiment of a visual indicator;

FIG. 2*b* transparent three-dimensional view of the segment of FIG. 2*a;*

Figure 3A:
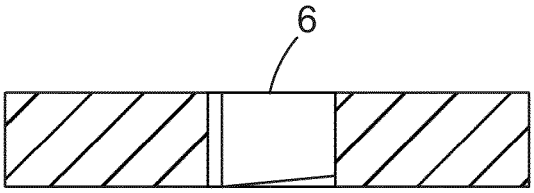
Figure 3B:
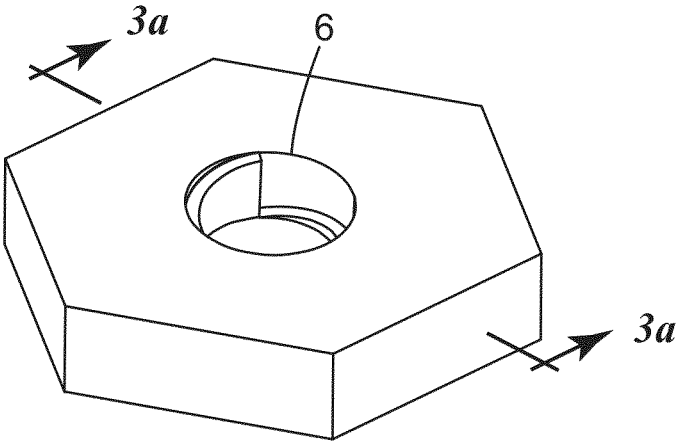

FIG. 3*a* cross-sectional view of a segment of an abrasive layer of an abrasive article with another embodiment of a visual indicator;

FIG. 3*b* transparent three-dimensional view of the segment of FIG. 3*a;*

Figure 4A:
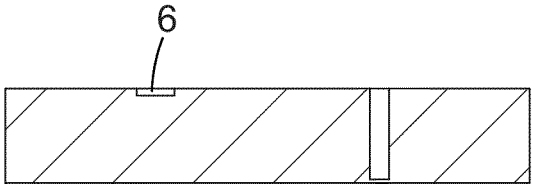
Figure 4B:
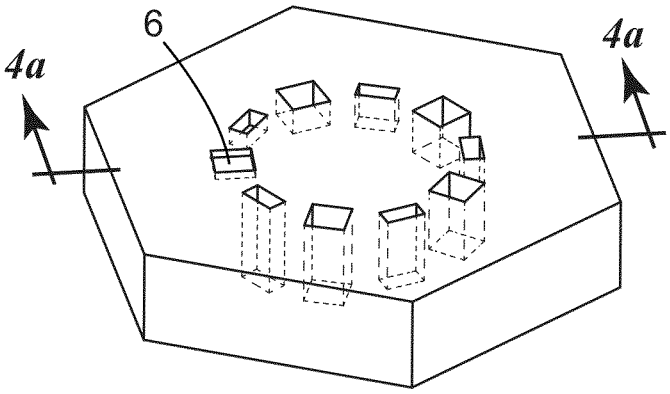

FIG. 4*a* cross-sectional view of a segment of an abrasive layer of an abrasive article with another embodiment of a visual indicator;

FIG. 4*b* transparent three-dimensional view of the segment of FIG. 4*a;*

Figure 5A:
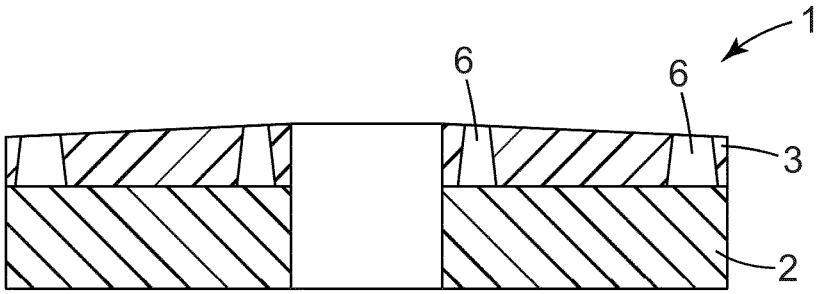
Figure 5B:
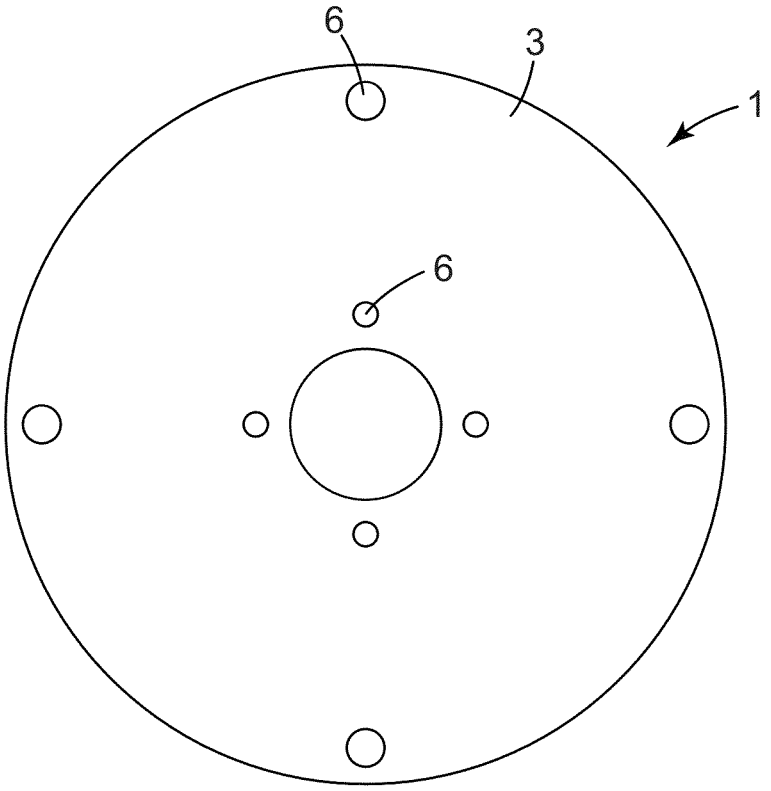

FIG. 5*a* top view of a grinding wheel according to one embodiment of the invention with several visual indicators;

FIG. 5*b* cross-sectional view of the grinding wheel of FIG. 5*a*; and

Figure 6A:
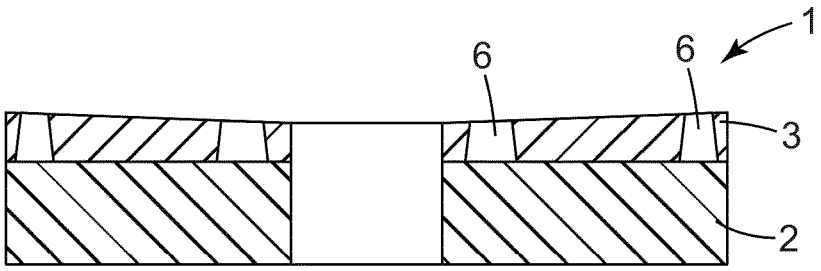
Figure 6B:
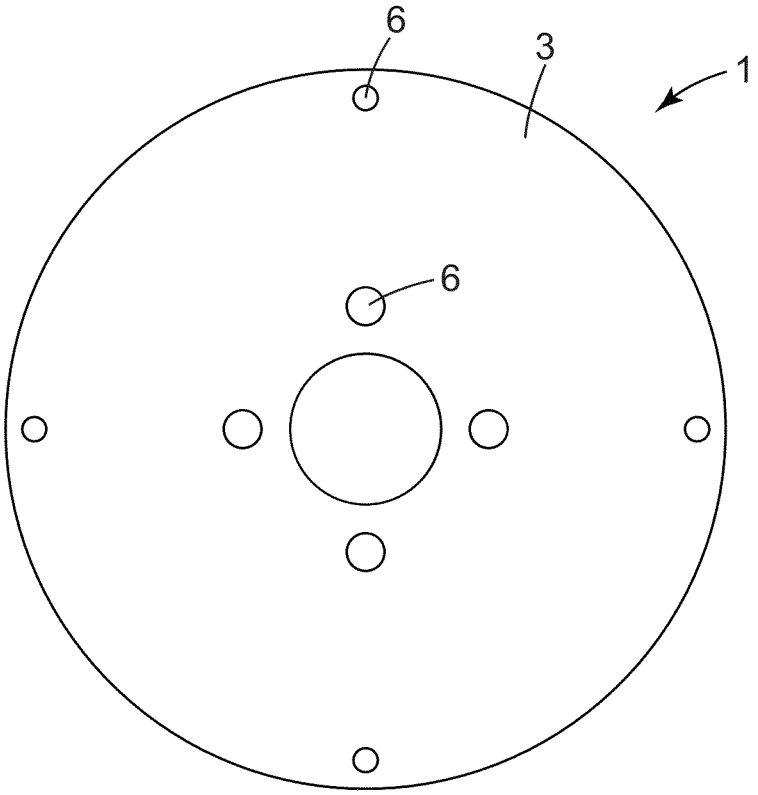
Figure 7:
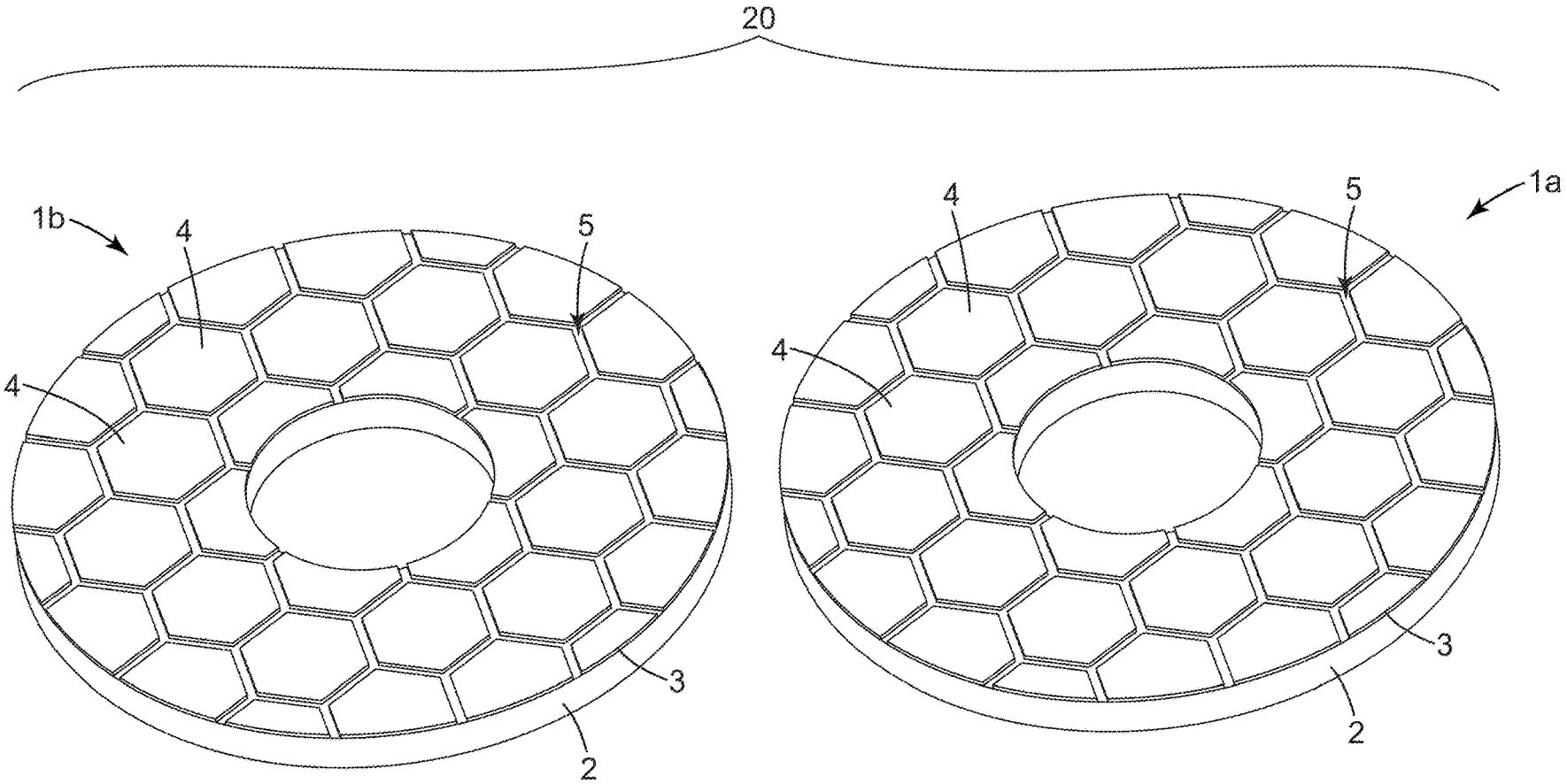

FIG. 6*a* top view of a grinding wheel according to another embodiment of the invention with several visual indicators;

FIG. 6*b* top view of the grinding wheel onto the main surface of the abrasive layer; and FIG. 7 three-dimensional view of a kit of parts comprising a pair of grinding wheels illustrated in FIG. 1.

Herein below various embodiments of the present invention are described and shown in the drawings wherein like elements are provided with the same reference numbers.

FIG. 1 shows a grinding wheel 1 with a carrier body 2 and an abrasive layer 3. The carrier body 2 has the shape of a disk and the abrasive layer 3 is arranged on one of its two parallel surfaces. The abrasive layer 3 provides a main surface which is built by a plurality of hexagonally shaped segments 4. The segments 4 are spaced apart from each other such that according channels 5 are created between the segments 4. The segments 4 are adhered to the carrier body 2.

FIGS. 2*a* to 4*b* show single segments 4 of the grinding wheel 1 shown in FIG. 1 from different perspectives. The segments show differently shaped visual indicators. FIG. 2*a* is a cross-sectional view of a segment 4 with a conically shaped visual indicator 6. FIG. 2*b* is a 3-dimensional view of the segment 4 of FIG. 2*a*. The visual indicator 6 reaches from the upper surface of the segment 4, which is part of the main surface of the grinding wheel 1, to the lower surface of the segment 4, which faces the carrier body 2 of the grinding wheel 1. The cross-section of the visual indicator 6 that extends parallel to the main surface of the abrasive article 1 according to the line 2*a*-2*a* in FIG. 2*b* changes through the thickness of the segment 4. In the embodiment shown in FIGS. 2*a* and 2*b* its size increases when the thickness of the abrasive layer gets reduced. It is of course also possible to arrange the visual indicator the other way around in the segment 4, such that the size of its cross-section in the main surface decreases when the thickness of the abrasive layer/segment also decreases. The size of the cross-section that is parallel to the main surface correlates to the thickness of the segment 4. FIGS. 2*a* and 2*b* the larger the cross-section of the visual indicator 6, the thinner is the segment 4.

FIG. 3*a* is a cross-sectional view of a segment 4 with a helically shaped visual indicator 6, that is built by a continuous ramp that is spirally formed. FIG. 3*b* is a 3-dimensional view of the segment 4 of FIG. 3*a*. The visual indicator 6 reaches from the upper surface of the segment 4, which is part of the main surface of the grinding wheel, to the lower surface of the segment 4, which faces the carrier body 2 of the grinding wheel 1. The cross-section of the visual indicator 6 that extends parallel to the main surface of the abrasive article 1 according to the line 3*a*-3*a* in FIG. 3*b* changes through the thickness of the segment 4. In the embodiment shown in FIGS. 3*a* and 3*b* it increases its size and it changes its shape. From a little dot it extends to a circular line. Thus, the size and the shape of the cross-section of the visual indicator 6 that is parallel to the main surface correlates to the thickness of the segment 4. The larger the cross-section of the visual indicator 6 and the more the line closes to a circle, the thinner is the segment 4.

FIG. 4*a* is a cross-sectional view of a segment 4 with a clock-like visual indicator 6. FIG. 4*b* is a 3-dimensional view of the segment 4 of FIG. 4*a*. The visual indicator 6 reaches from the upper surface of the segment 4, which is part of the main surface of the grinding wheel, to the lower surface of the segment 4, which faces the carrier body 2 of the grinding wheel 1. The cross-section of the visual indicator 6 that extends parallel to the main surface of the abrasive article 1 according to the line 4*a*-4*a* in FIG. 4*b* changes through the thickness of the segment 4. In the embodiment shown in FIGS. 4*a* and 4*b* it comprises several indicator marks that are arranged in a circle like the numbers of a clock. Each of the indicator marks has a different height in the thickness direction of the abrasive layer. Going along the circle, they increase in their height. Depending on the thickness of the segment 4 the number of indicator marks visible on the main surface of the segment 4 increase. If all indicator marks are visible the circle is complete. This is an indication that the abrasive layer is almost worn off and the tool needs to be exchanged soon. If several segments 4 with clock like visual indicators 6 are used in one tool, it is possible to compare the number of visible indicator marks of each visual indicator 6 in the tool to determine if the main surface of the abrasive article 1 still as plane as required for achieving good grinding results.

FIGS. 5*a* to 6*b* show abrasive articles 1 with several visual indicators 6 that have been used already and that provide a worn off non-planar main surface. The grinding wheel 1 of FIG. 5*a* comprises a carrier body 2 and an abrasive layer 3. Within the abrasive layer 3 several visual indicators 6 are arranged in an inner and an outer ring. They have a conical shape. The abrasive article 1 is more worn off at the outer edge as in the middle. This can clearly be seen in FIG. 5*b* which is a top view of the grinding wheel 1 onto the main surface of the abrasive layer 3. The visual indicators 6 of the outer circle have a larger diameter as the visual indicators 6 of the inner circle. This means that more material has been worn off on the outside of the grinding wheel 1 as on the inside.

FIG. 6*a* shows the opposite scenario. The grinding wheel 1 of FIG. 6*a* comprises a carrier body 2 and an abrasive layer 3. Within the abrasive layer several visual indicators are arranged in an inner and an outer ring. They have a conical shape. The abrasive article 1 is more worn off in the middle as on the outer side. This can clearly be seen in FIG. 6*b* which is a top view of the grinding wheel 1 onto the main surface of the abrasive layer 3. The visual indicators 6 of the inner circle are larger as the visual indicators 6 of the outer circle. This means that more material has been worn off on the inside of the grinding wheel 1 as on the outside.

FIG. 7 illustrates a kit of parts 20 comprising a pair of abrasive articles 1*a*, 1*b* of the present invention, illustrated as grinding wheels, that may be used in a double disk grinding process. Abrasive articles 1*a*, 1*b* are the same as abrasive article 1 in FIG. 1.

The invention claimed is:

1. An abrasive article for abrading at least one workpiece, the abrasive article comprising:

a carrier body; and at least one abrasive layer with a main surface that faces away from the carrier body and a predefined thickness, the main surface of the at least one abrasive layer being arranged in segments on the carrier body, wherein the abrasive article is a disk, and the main surface extends in a radial direction of the abrasive article, and wherein at least two of the segments comprise visual indicators with a cross-section in the main surface of the abrasive layer, wherein the size, shape and/or location of the cross-section of each visual indicator in the main surface of the abrasive layer depends on the thickness of the abrasive layer where that visual indicator is located, wherein each of the visual indicator has a different height in the thickness direction of the abrasive layer, wherein each of the visual indicators comprises a discrete element, wherein the discrete elements are arranged in a circle in a clock like system in a corresponding segment such that going along the circle, the height of a subsequent indicator increases, and wherein the discrete elements appear or disappear in a defined order during the use of the abrasive article while the thickness of the abrasive layer is reduced.

2. The abrasive article according to claim 1, wherein the visual indicators comprise a predefined shape with a cross-section that is visible on the main surface of the abrasive layer.

3. The abrasive article according to claim 1, wherein the cross-section of the visual indicators is visible through a whole tool lifetime of the abrasive article.

4. The abrasive article according to claim 1, wherein the visual indicators comprise a cross-section in a plane parallel to the main surface of the abrasive layer that varies through the thickness of the abrasive layer.

5. The abrasive article according to claim 1, wherein the abrasive article comprises more than two visual indicators, wherein the visual indicators are equally shaped, sized and/or arranged at the same height.

6. The abrasive article according to claim 4, wherein the visual indicators are arranged in a pattern in the abrasive layer.

7. The abrasive article according to claim 1, wherein the visual indicators comprise a different color than the abrasive layer.

8. The abrasive article according to claim 1, wherein the visual indicators comprise a different material than the abrasive layer.

9. The abrasive article according to claim 1, wherein the abrasive article is a grinding wheel or a dressing ring.

10. A kit of parts comprising a pair of abrasive articles for use in a double disk grinding process, wherein at least one of the abrasive articles is an abrasive article according to claim 1.

* * * * *